United States Patent [19]

Ellis

[11] 4,200,945

[45] May 6, 1980

[54] BOOK AND HANGING DEVICE

[76] Inventor: Leslie E. Ellis, P.O. Box 52298, Jacksonville, Fla. 32201

[21] Appl. No.: 936,515

[22] Filed: Aug. 24, 1978

[51] Int. Cl.[2] ..... B42C 1/00

[52] U.S. Cl. ..... 11/1 ET; 11/4; 281/15 A; 281/45

[58] Field of Search ..... 206/450, 493, 554, 806; 281/15 R, 15 A, 45; 11/1 R, 1 ET, 1 MB, 1 AD, 3, 4

[56] References Cited

U.S. PATENT DOCUMENTS

| | | | |
|---|---|---|---|
| 237,163 | 2/1881 | Brumm | 281/15 |
| 1,798,656 | 3/1931 | Chapman | 281/15 A |
| 2,215,163 | 9/1940 | Shedd | 281/15 |
| 2,523,129 | 9/1950 | Maier | 206/424 |

FOREIGN PATENT DOCUMENTS

| | | | |
|---|---|---|---|
| 1218995 | 6/1966 | Fed. Rep. of Germany | 281/45 |
| 1480373 | 4/1967 | France | 206/806 |
| 130568 | 8/1919 | United Kingdom | 281/15 |

*Primary Examiner*—Paul A. Bell

[57] ABSTRACT

A combination of a book and a hanging device therefor is disclosed which includes a pair of apertured, perforated hanging tabs attached to the front and rear cover portions of the book and protruding beyond the top edge of the book. The book may thus be hung in an upright, closed position on a peg for display purposes, the hanging tabs being readily manually removable when no longer needed. A method of making the book and hanging device is also disclosed.

20 Claims, 5 Drawing Figures

BOOK AND HANGING DEVICE

BACKGROUND OF THE INVENTION

1. Field of the Invention

The present invention relates generally to the combination of a book and hanging device therefor, and a method of making such combination and, more particularly, to such a combination and method wherein the hanging device can be readily manually removed when no longer needed.

2. Description of the Prior Art

Operators of grocery stores and other commercial establishments often find it desirable to place books, particularly the paperback type, on display for sale in various locations throughout their stores. For example, in a food market having a section of shelves for baby foods, it would be desirable to display for sale paperback books which contain information relating to the nutritional content of baby foods. Many stores do not have the space required for displaying such books on shelves in the particular section of the store where display would be advantageous. It would be particularly advantageous if books could be hung from existing shelves on the commonly used pegs which extend outwardly from the edges of these shelves. Such pegs are commonly used to support merchandise in "blister packs" and plastic bags, and have the advantage of neatly displaying this merchandise without appreciably obscuring the shelved items from view. Short of wrapping a book in a separate plastic hanging bag, no practical way exists for hanging a book on a peg by means of a simple, inexpensive hanging device attached to the book, which may be readily removed when no longer needed.

The prior art discloses a number of books having hangers attached thereto. The following four patents appear to be most relevant to the present invention.

Brumm (U.S. Pat. No. 237,163) discloses a book having a wire loop hanger attached to the cover hinges adjacent the binding. The loop is adapted to be engaged by a supporting chain or the like, and the covers are provided with a clasp for maintaining the book in a closed position when not in use. The book cannot be readily detached from its hanger or its supporting chain when the hanging feature is no longer desired, and the hanger and clasp remain as permanent, protruding appendages.

Shedd (U.S. Pat. No 2,215,163) discloses a combined book and coupon unit having a hanging hole punched completely through the cover and the leaves of the book near the top edge thereof. A clasp is similarly provided to maintain the book in a closed position. Depending projecting coupons, attached to the bottom edges of the leaves by means of perforated connections, may be removed by tearing when needed. The hanging hole of this book permanently remains as part of the book structure, and occupies space near the top of each page which might otherwise be occupied by printed matter, thereby requiring additional pages to accommodate the entire text.

Maier (U.S. Pat. No. 2,523,129) discloses a carrying case comprising a combination book cover and wallet having a pair of handles and a storage compartment. The handles are provided for convenient transportation of the book, but may be omitted or removed by cutting them off. This book cover is not a device for hanging a book for display purposes at all, and is separate and distinct from the book itself. It is much more complex and, therefore, expensive to fabricate than would be desired in a combined book and hanging device.

Woolfson (British No. 130,568) discloses a book having a projecting apertured hanging tab connected to one cover. A hanging ring is received in the apertured hanging tab, the book being adapted to be suspended from a watch chain or the like. Since the book is suspended from the top edge of one cover only, it would tend to hang in an open position. To prevent this, a clasp is provided for holding the book in a closed position when not in use. As with the book of Brumm, Woolfson's book similarly cannot be detached from its hanging tab or supporting chain when the hanging feature is no longer desired, and the hanging tab and clasp remain as permanent, protruding appendages.

SUMMARY OF THE INVENTION

Accordingly, it is an object of the present invention to obviate the above-noted disadvantages of the prior art by providing a combination of a book and a simple, inexpensive hanging device which may be readily removed when no longer needed.

Another object of the invention is to provide a combined book and hanging device which enables the book to be hung upon a peg or similar support, and wherein the hanging device may be readily manually removed when no longer needed without the use of cutting implements of any type.

A further object of the invention is to provide a combined book and hanging device which enables the book to be hung in a closed position without the aid of cumbersome clasping devices.

A further object of the invention is to provide a method for making such a combined book and hanging device.

These and other objects of the present invention are accomplished by a combined book and hanging device having a pair of parallel, opposed hanging tabs which are connected to the front and rear cover portions of the book and project beyond the top edge of the book. By providing a hanging tab for each cover, the book will hang freely in a closed position. The tabs may be apertured if it is desired to support the book on a peg or similar support. The connections between the hanging tabs and the cover portions preferably include perforations along which the hanging tabs may be separated from the cover portions.

In the method of making such a combined book and hanging device the leaves of the book are first bound to a first cover, the assembly being trimmed, if necessary, on three sides. A second cover having a top portion which projects beyond the top edge of the book is then laminated to the first cover and may be trimmed on two sides, the top portion being cut to the desired shape. This top portion forms the hanging tabs, which are perforated along the top edge of the book. If desired, a third cover (for example, a hard cover) may be laminated to the second cover, the hanging tabs thus projecting beyond the top edge of the book from between the first and third covers.

BRIEF DESCRIPTION OF THE DRAWING

The novel features of the invention are set out with particularity in the appended claims, but the invention will be understood more fully and clearly from the following detailed description of the preferred embodiments of the invention as set forth in the accompanying drawing, in which:

DESCRIPTION OF THE PREFERRED EMBODIMENTS

In the description that follows, the present invention will be described with reference to a book with hanging tabs which can be supported on a peg or similar support. It is to be understood, however, that the book can be supported from any support which engages the hanging tabs projecting from the top edge of the book.

Figure 1:
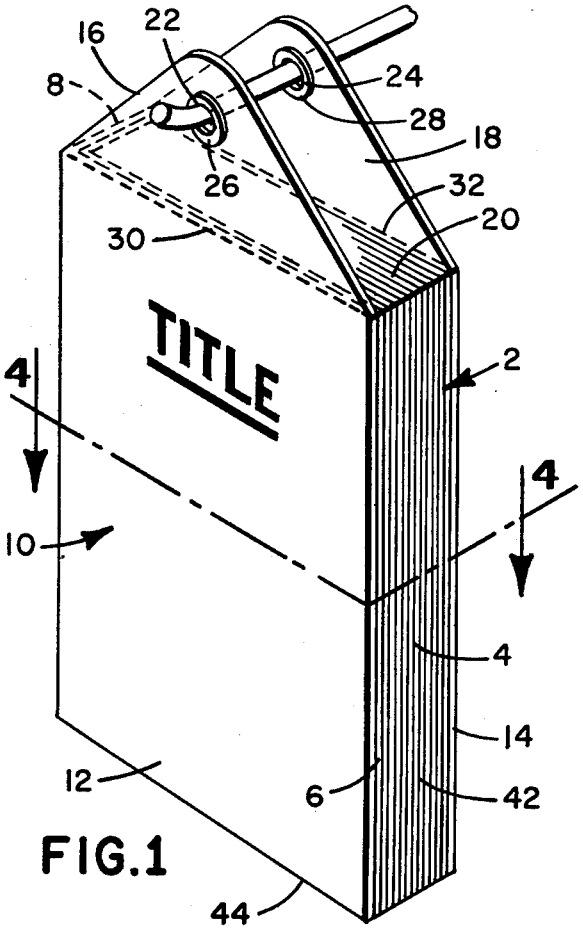
FIG. 1 is a perspective view of the book and hanging device according to the present invention suspended on a peg.
Figure 2:
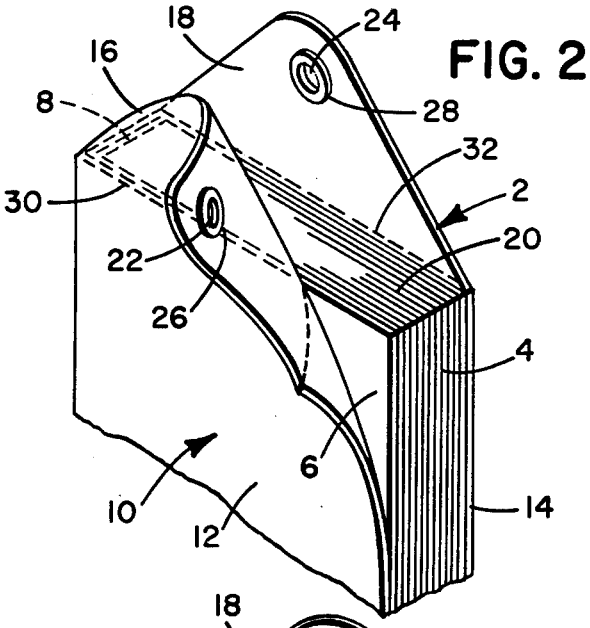
FIG. 2 is a perspective view of the book and hanging device of FIG. 1, showing a portion of the second cover folded back and separated from the first cover.
Figure 4:
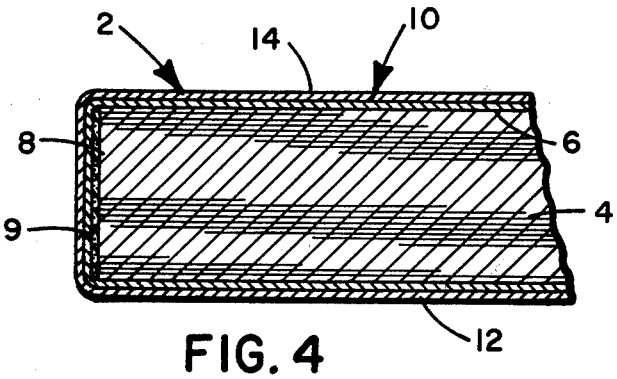
FIG. 4 is a cross-sectional view taken along line 4—4 of FIG. 1.

The construction of a book and hanging device according to the embodiment illustrated in FIGS. 1, 2 and 4 would be applicable to books of the paperback type. The book and hanging device 2 comprises a plurality of leaves 4 bound to a first cover 6 along a bound edge 8 with adhesive 9. A second cover 10 having front and rear cover portions 12 and 14 respectively, and hanging tabs 16 and 18 projecting beyond the top edge 20 of the book, is laminated to the first cover 6. Holes 22 and 24 are punched in the hanging tabs 16 and 18 near the top center thereof, and are reinforced with eyelets 26 and 28. Perforations 30 and 32 are formed in the second cover 10 along the top edge of the book 20. The book is thus adapted to be hung on a peg or similar support 34 in a closed position, and the hanging tabs 16 and 18 may be readily manually removed by tearing along perforations 30 and 32 when no longer needed.

Hanging tabs having any desired shape may be used, but the shape illustrated in FIGS. 1 and 2 is particularly advantageous in view of the method used to assemble the book. This shape generally resembles a portion of an oval, the hanging tabs thus rising from the bound edge at an angle thereto. Since the adhesive used to laminate the second and first covers together will invariably ooze from between these covers along the bound edge, die cutting this oval shape will serve to remove any excess glue which may have so oozed, providing hanging tabs of pleasing appearance with a logical place for a hanging hole.

Figure 3:
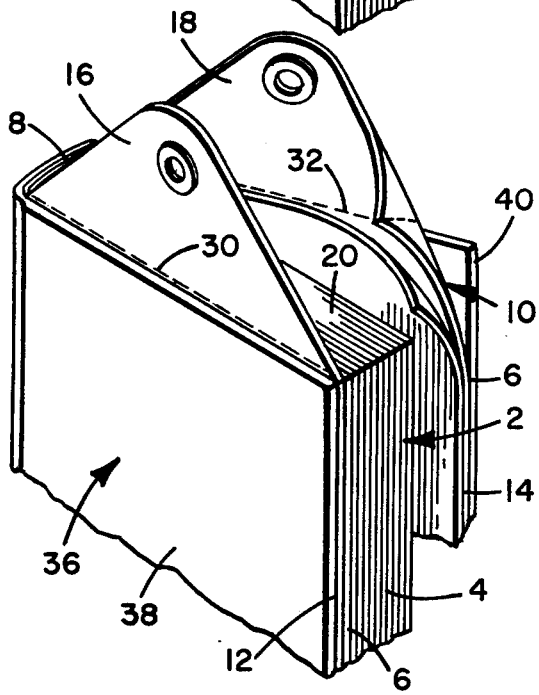
FIG. 3 is a perspective view of an alternative embodiment of the book and hanging device according to the present invention, showing details of construction which may be applied to a hard cover version.
Figure 5:
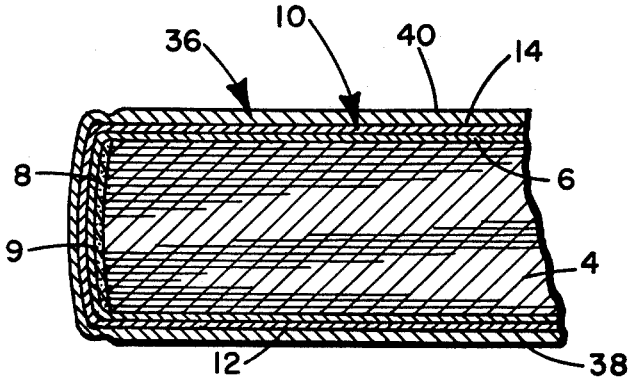
FIG. 5 is a cross-sectional view similar to FIG. 4 of the embodiment shown in FIG. 3.

In the embodiment of the book and hanging device illustrated in FIGS. 3 and 5, a third cover 36 having front and rear cover portions 38 and 40 respectively, is laminated to a book and hanging device having the structure of the embodiment of FIGS. 1, 2 and 4. Thus, hanging tabs 16 and 18 project beyond the top edge 20 of the book from between first cover 6 and third cover 36. This construction may be used for hard cover books, wherein third cover 36 includes a hard cardboard cover which is laminated to a soft cover book having a blank second cover.

The method of manufacturing the book and hanging device according to the embodiment of FIGS. 1, 2 and 4 is, therefore, identical to the method of constructing the book of the embodiment of FIGS. 3 and 5, except for the step of laminating the third cover.

The initial steps relate to a conventional book binding method. Thus, a plurality of leaves or signatures are assembled in proper order and orientation and bound with adhesive 9 to a first blank cover 6 along a binding edge 8. Signatures may consist of any number of pages as conventionally used in the bookbinding art. This assembly is then trimmed along the top edge 20, side edge 42 and bottom edge 44, thereby removing any excess adhesive which may have oozed from between first cover 6 and the signatures or leaves at the top and bottom of the binding edge. Where signatures are employed, this cutting operation serves to open the signatures into leaves. Next, a second larger cover 10 is laminated, with adhesive, to the first cover 6. The second cover is then trimmed along the bottom edge 44 and side edge 42, and is perforated along the top edge 20 to form perforations 30 and 32. The projecting top portion of the second cover 10 is then die cut in the general shape of a portion of an oval, thereby removing any adhesive which may have oozed from the binding edge 8 at its top end, removing a strip of the second cover 10 adjacent to the binding, and forming two separate, parallel opposed hanging tabs 16 and 18. Holes 22 and 24 are then punched in these hanging tabs, and are reinforced with eyelets 26 and 28. To form a book and hanging device according to the embodiment of FIGS. 3 and 5, the additional step of laminating a third cover 36 is performed.

In the method according to the invention, the perforating step may be performed prior to binding by using a second cover which has perforations already formed therein. These perforations would be formed along a line which will coincide with the top edge of the book when bound. Where printed matter is to appear on the second cover, this perforating step could be performed simultaneously with printing.

The present invention therefore provides a book having a hanging device which can be simply and economically incorporated into the structure of the book during the manufacture thereof, and permits the book to be hung freely in an upright, closed position by hanging tabs which can be readily manually removed when no longer needed.

Although the present invention has been illustrated in terms of preferred embodiments, it will be obvious to one of ordinary skill in the art that numerous modifications may be made without departing from the true spirit and scope of the invention which is to be limited only by the appended claims. For example, it is apparent that any binding process may be used to bind the leaves or signatures to the first cover, such as gluing and stitching, stitching alone or spiral binding. In the case of spiral binding, the book cover would consist of front and rear cover portions spirally bound to the leaves, each cover portion comprising, in its simplest form, a single sheet of material having an integrally formed projecting hanging tab perforated along the top edge of the book. Furthermore, it is apparent that in the case of a book having a third cover (for example, a hard cover book), the second cover bearing the hanging tabs need not extend the full length of the book, but need only extend a sufficient distance between the first and third covers to form a bond sufficient to bear the weight of the book.

I claim:

1. A method of making a book and hanging device which is attached to said book and projects beyond the top edge thereof comprising the steps of:
assembling a plurality of leaves in proper order and orientation for binding; and
binding a cover having front and rear cover portions to said leaves along a binding edge, each of said cover portions comprising a hanging tab projecting beyond said top edge, and having perforations formed therein which extend along said top edge.

2. In a book having a cover with front and rear cover portions and a plurality of leaves disposed within and bound to said cover; a hanging device comprising:
first hanging means connected to said front cover portion;
second hanging means connected to said rear cover portion;
said first and second hanging means projecting beyond the top edge of the book; and
each of the connections between said hanging means and said cover portions comprising separating means for facilitating the ready manual removal of said hanging means when no longer needed.

3. A book as claimed in claim 2 wherein said separating means comprise perforations formed in said hanging means.

4. A book as claimed in claim 3 wherein said perforations extend along the top edge of the book.

5. A book as claimed in claim 2 wherein said hanging means are formed integrally with said cover as parts of the same cover material.

6. A book as claimed in claim 2 wherein said hanging means are laminated to said cover.

7. A book as claimed in claim 2 wherein a hole is formed in each of said hanging means, said holes being in axial alignment for receipt of a support member.

8. A book as claimed in claim 7 wherein said holes are reinforced with eyelets.

9. A book as claimed in claim 2 wherein said hanging means are substantially identical and have the general shape of a portion of an oval.

10. In a book having a bound edge, a top edge, a plurality of leaves, a first cover surrounding said leaves and bound thereto along said bound edge, a second cover surrounding said first cover and said leaves and laminated to said first cover, said second cover having front and rear cover portions; a hanging device comprising:
a first hanging tab integrally formed with said front cover portion;
a second hanging tab integrally formed with said rear cover portion;
said hanging tabs projecting beyond said top edge and having the general shape of a portion of an oval;
a hole reinforced with an eyelet formed in each of said hanging tabs; and
perforations formed in each of said hanging tabs along said top edge, whereby the book may be hung by said eyeleted holes on a peg or other support in a closed position, and said hanging tabs may be readily manually removed by tearing along said perforations when no longer needed.

11. A method of making a book and hanging device which is attached to said book and projects beyond the top edge thereof comprising the steps of:
assembling a plurality of leaves in proper order and orientation for binding;
binding a first cover to said leaves along a binding edge;
laminating a second cover to said first cover with a portion of said second cover projecting beyond said top edge; and
perforating said second cover along said top edge, whereby the portion of said second cover which projects beyond said top edge comprises two parallel, opposed hanging tabs for supporting the book.

12. A method of making a book and hanging device which is attached to said book and projects beyond the top edge thereof comprising the steps of:
assembling a plurality of leaves in proper order and orientation for binding;
binding a first cover to said leaves along a binding edge; and
laminating a second cover having perforations formed therein to said first cover with a portion of said second cover projecting beyond said top edge and said perforations extending along said top edge, whereby the portion of said second cover which projects beyond said top edge comprises two parallel, opposed hanging tabs for supporting the book.

13. A method as claimed in claims 11 or 12 further comprising the step of trimming said first cover and said leaves on all edges except said binding edge prior to laminating said second cover.

14. A method as claimed in claim 13 wherein said second cover is larger than the trimmed first cover, further comprising the step of trimming said second cover along all edges except said binding edge and said top edge prior to perforating said second cover.

15. A method as claimed in claim 13 wherein the step of assembling said leaves comprises assembling a plurality of signatures.

16. A method as claimed in claims 11 or 12 further comprising the step of cutting said hanging tabs to a desired shape.

17. A method as claimed in claims 11 or 12 further comprising the step of punching a hole through each of said hanging tabs.

18. A method as claimed in claim 17 further comprising the step of reinforcing said holes with eyelets.

19. A method as claimed in claims 11 or 12 further comprising the step of laminating a third cover to said second cover, whereby said hanging tabs project beyond said top edge from between said first and third covers.

20. A method of making a book having a bound edge, a top edge, an open side edge and a bottom edge, and a hanging device attached thereto and projecting beyond said top edge, comprising the steps of:
assembling a plurality of signatures in proper order and orientation for binding;
binding a first cover to said signatures along said bound edge;
trimming said first cover and said signatures along said top, side and bottom edges to open said signatures into leaves and obtain straight edges;
laminating a second cover, larger than said first cover, to said first cover;
trimming said second cover along said side and bottom edges;
perforating said second cover along said top edge;
die cutting the portion of said second cover which projects beyond said top edge in the general shape of a portion of an oval, whereby any adhesive which may have escaped from said bound edge at its top end is removed along with the adjacent projecting strip of said second cover, and said portion of said second cover which projects beyond said top edge is cut into two separate, parallel, opposed hanging tabs;

punching a hole in each of said hanging tabs near the top center thereof; and reinforcing each of said holes with an eyelet, whereby said book may be suspended upright in a closed position on a peg or other support received in said eyeleted holes, and said hanging tabs may be readily manually removed by tearing along said perforations when no longer needed.

* * * * *